US008650866B2

(12) United States Patent
Coe

(10) Patent No.: US 8,650,866 B2
(45) Date of Patent: Feb. 18, 2014

(54) EXHAUST INSERT FOR EXHAUST PORT

(75) Inventor: James Coe, Rocky Gap, VA (US)

(73) Assignee: Caterpillar Global Mining America LLC, South Milwaukee, WI (US)

( * ) Notice: Subject to any disclaimer, the term of this patent is extended or adjusted under 35 U.S.C. 154(b) by 827 days.

(21) Appl. No.: 12/814,939

(22) Filed: Jun. 14, 2010

(65) Prior Publication Data

US 2011/0303179 A1 Dec. 15, 2011

(51) Int. Cl.
*F01N 1/00* (2006.01)

(52) U.S. Cl.
USPC ..... 60/323; 60/313; 60/324

(58) Field of Classification Search
USPC ..... 60/313, 323, 324
See application file for complete search history.

(56) References Cited

U.S. PATENT DOCUMENTS

| | | | | |
|---|---|---|---|---|
| 3,635,031 | A * | 1/1972 | Haddad | 60/282 |
| 3,983,696 | A * | 10/1976 | Pflugfelder | 60/272 |
| 4,187,678 | A | 2/1980 | Herenius | |
| 4,195,477 | A * | 4/1980 | Yamazaki et al. | 60/282 |
| 6,523,343 | B2 * | 2/2003 | Durr et al. | 60/323 |

FOREIGN PATENT DOCUMENTS

| | | |
|---|---|---|
| DE | 2616028 | 4/1976 |
| DE | 2715513 | 4/1977 |
| DE | 102006023814 A1 | 11/2007 |
| GB | 1546661 | 4/1976 |
| GB | 1546662 | 4/1976 |
| JP | 07-279636 | 10/1995 |
| KR | 199826314 | 8/1998 |
| KR | 199851634 | 10/1998 |
| KR | 200216038 | 3/2002 |
| KR | 20040016551 | 2/2004 |

OTHER PUBLICATIONS

International Search Report and Written Opinion for International Application No. PCT/US2011/039565, mail date Feb. 21, 2012, 6 pages.

* cited by examiner

*Primary Examiner* — Thomas Denion
*Assistant Examiner* — Diem Tran
(74) *Attorney, Agent, or Firm* — Foley & Lardner LLP

(57) ABSTRACT

An exhaust insert for use with an internal combustion engine transfers heat from exhaust gases to a liquid-cooled exhaust manifold. One end of the exhaust insert extends into the exhaust port of a cylinder head, and the other end of the exhaust insert extends into an exhaust manifold. Exhaust gases are received from the cylinder head by the exhaust manifold through the exhaust insert. The exhaust insert is in contact with a surface of the exhaust manifold so as to transfer heat from the exhaust gases away from the cylinder head to the exhaust manifold.

26 Claims, 4 Drawing Sheets

EXHAUST INSERT FOR EXHAUST PORT

BACKGROUND

1. Technical Field

The present invention relates to internal combustion engines, and more particularly, to exhaust systems for internal combustion engines.

2. Related Art

Internal combustion engines include exhaust systems for allowing exhaust gases to escape from within the combustion chamber or cylinder. The exhaust gases usually escape through an exhaust port in the engine block, then through an exhaust manifold that directs the exhaust gases to exhaust pipes for directing the exhaust gases away from the engine. Since the exhaust gases are usually very hot, some amount of the heat is transferred to components of the exhaust system. For example, the exhaust port and exhaust manifold will become very hot during operation because of heat transferred from exhaust gases.

There are a number of advantages to preventing the engine block from getting too hot. For example, excess heat can reduce engine performance, reduce the life of engine components, or even damage the engine block itself. Therefore, it is desirable to reduce the temperature of the engine and engine components. For example, it is common for engines to include a liquid cooling system for carrying away heat from the engine. Despite such past efforts, there remains a need for further improvements in dissipating heat from internal combustion engines.

BRIEF DESCRIPTION OF THE DRAWINGS

Features, aspects, and embodiments of the inventions are described in conjunction with the attached drawings, in which.

DETAILED DESCRIPTION

Figure 1:
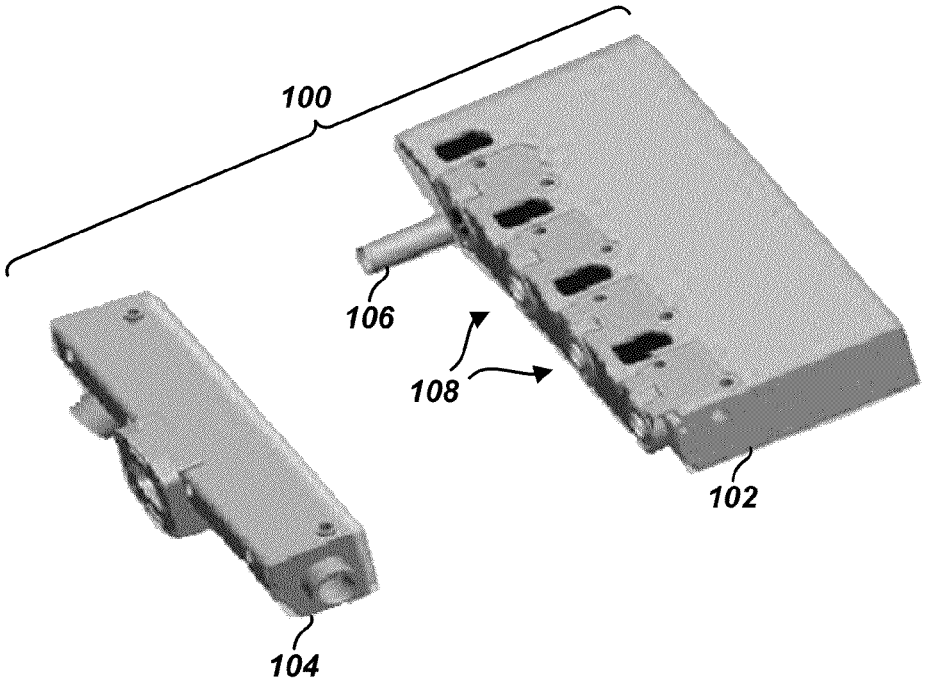
FIG. 1 shows an exploded view of a portion of an engine assembly.

FIG. 1 shows an exploded view of a portion of an engine assembly 100. The engine assembly 100 includes a cylinder head 102, an exhaust manifold 104, and a plurality of exhaust inserts 106. The engine assembly 100 can include other conventional engine components that are not shown. For example, the cylinder head 102 can be mounted to an engine block so as to form a number of combustion chambers containing respective pistons. The cylinder head 102 can include a valve assembly that includes valves for controlling the flow of exhaust gases from the combustion chambers to the exhaust manifold 104. The engine assembly 100 can form a portion of a diesel or regular gasoline engine.

Figure 2:
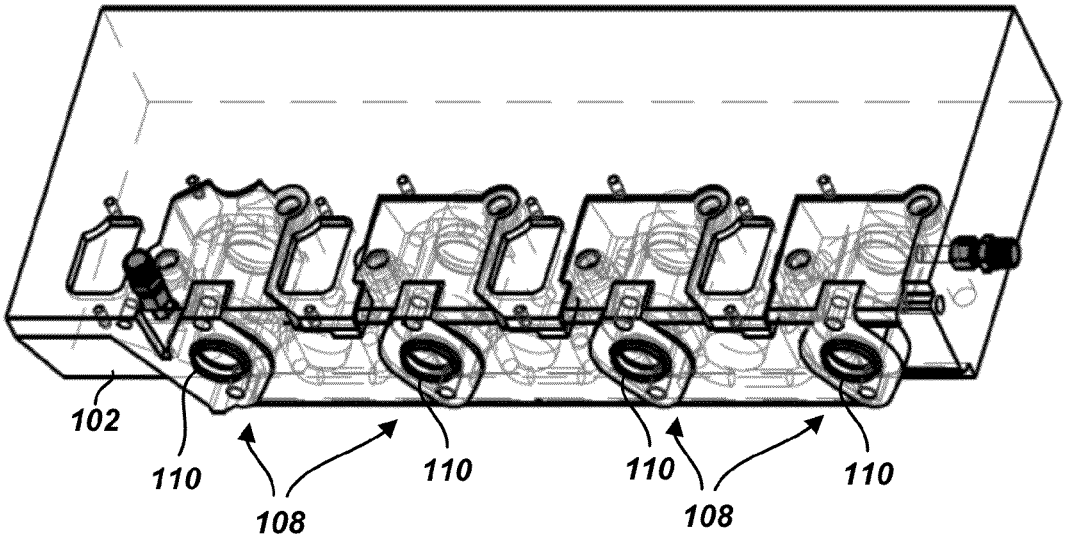
FIG. 2 shows a perspective view of a cylinder head of the engine assembly shown in FIG. 1.

FIG. 2 shows a perspective view of the cylinder head 102. The cylinder head 102 includes a plurality of exhaust ports 108. While four exhaust ports 108 are shown, the present disclosure is equally applicable to cylinder heads having other numbers of exhaust ports. The cylinder head 102 is configured to be mounted onto an engine block such that each of the exhaust ports 108 can provide a conduit through which exhaust gases can escape from respective combustion chambers. The cylinder head 102 can include a conventional valve assembly for controlling the flow of gasses from the combustion chambers to the exhaust ports 108. Each of the exhaust ports 108 includes an output opening 110 through which the exhaust gases can exit the cylinder head 102 and enter the exhaust manifold 104.

Figure 3:
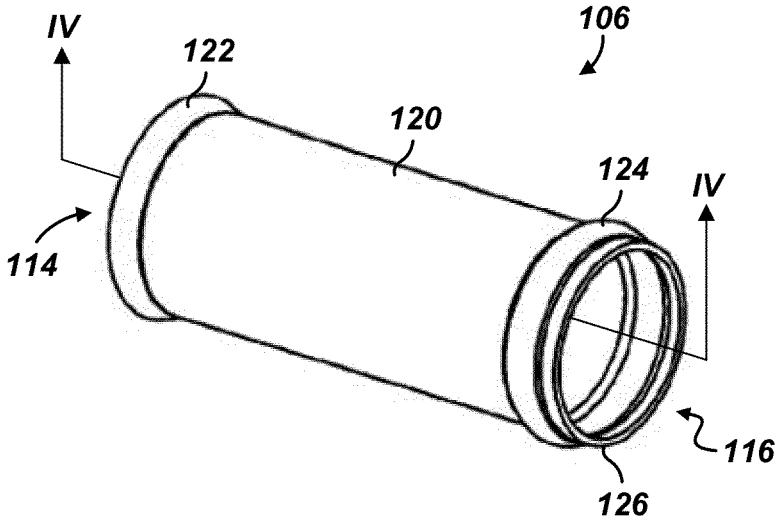
FIG. 3 shows a perspective view of an exhaust insert.
Figure 4:
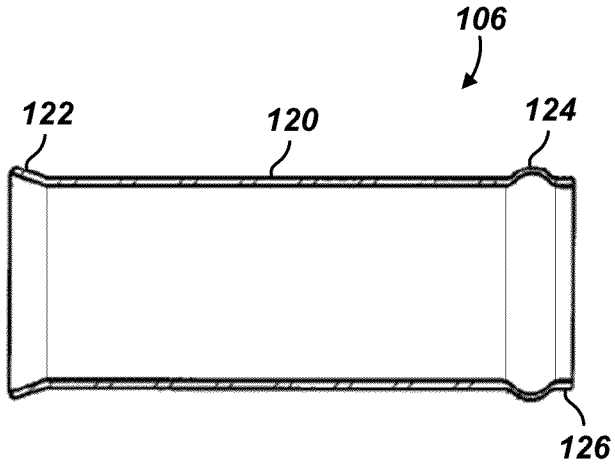
FIG. 4 shows a cross-sectional view of the exhaust insert taken along section line IV-IV in FIG. 3.

FIG. 3 shows a perspective view of the exhaust insert 106, and FIG. 4 shows a cross-sectional view of the exhaust insert 106 taken along section line IV-IV in FIG. 3. In the illustrated embodiment, the exhaust insert 106 is generally cylindrical so as to conform at least somewhat to the interior shape of an exhaust port 108. It will thus be appreciated that alternative shapes are possible in order to conform to other exhaust ports. For example, while the exhaust insert 106 is generally linearly cylindrical, alternative embodiments can be generally curvilinearly cylindrical. Also, while the exhaust insert 106 has a somewhat circular cross-section (taken perpendicular to the section lines IV-IV), alternative embodiments can have alternative cross-sectional shapes.

The exhaust insert 106 includes an input end 114 and an output end 116. When the exhaust insert 106 is installed in the cylinder head 102, exhaust gases from a combustion chamber are received by the input end 114 and exit through the output end 116. A cylindrical region 120 extends between the input end 114 and the output end 116. In this embodiment, the exhaust insert 106 includes a flared region 122 in the vicinity of the input end 114. The exhaust insert 106 also includes a beaded region 124 in the vicinity of the output end 116. The exhaust insert 106 is configured such that the outside diameter of the cylindrical region 120 is less than an outside diameter of the flared region 122, and the outside diameter of the cylindrical region 120 is also less than an outside diameter of the beaded region 124. In the illustrated embodiment, the outside diameter of the cylindrical region 120 is at least somewhat constant along the longitudinal axis of the exhaust insert 106. However, in alternative embodiments, the outside diameter of the cylindrical region 120 can vary. Also, while one flared region 122 and one beaded region 124 are shown, alternative embodiments can include additional regions of increased diameter, such as additional beaded regions 124.

The output end 116 of the exhaust insert 106 also includes a cylindrical extension 126. The cylindrical extension 126 extends between the beaded region 124 and the output end 116 of the exhaust insert 106. The outside diameter of the cylindrical extension 126 can be approximately equal to the outside diameter of the cylindrical region 120 as shown in FIG. 4. Alternatively, the outside diameter of the cylindrical extension 126 can differ from the outside diameter of the cylindrical region 120. When the exhaust insert 106 is installed in the engine assembly 100, the cylindrical extension 126 will extend into a manifold port of the exhaust manifold 104. Thus, the outside diameter of the cylindrical extension 126 can be configured to fit within a port of the exhaust manifold 104.

Figure 5:
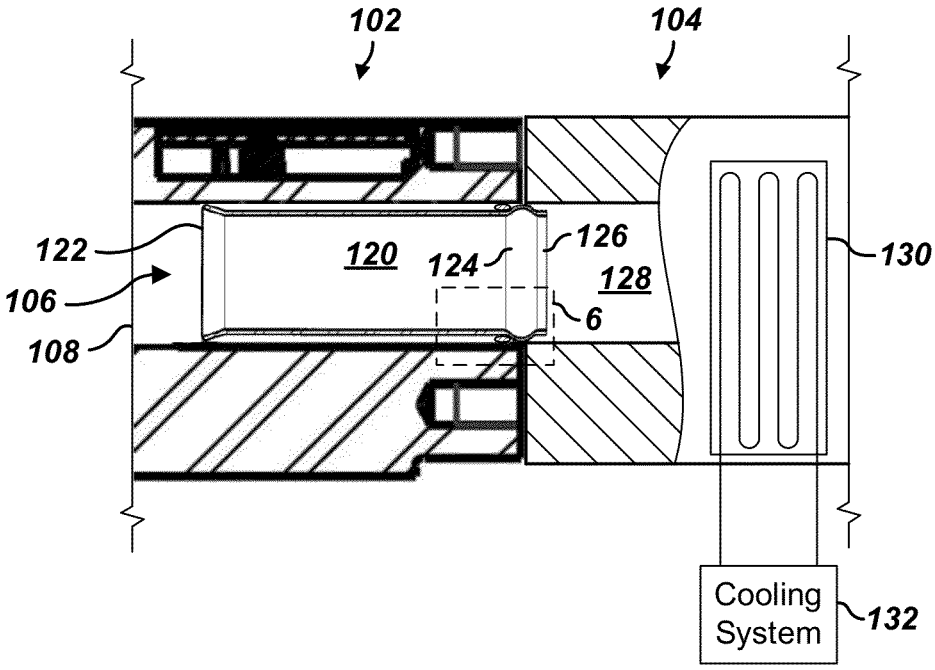
FIG. 5 shows a partially sectioned view of the engine assembly.
Figure 6:
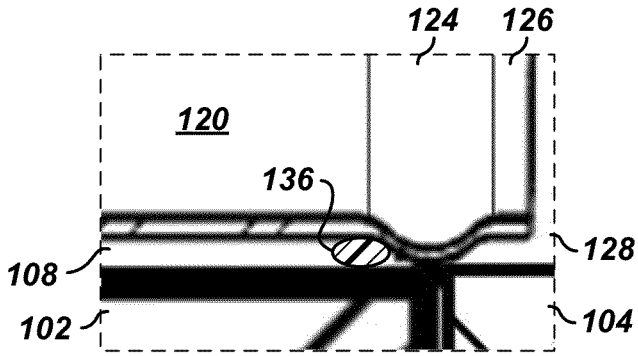
FIG. 6 shows an enlarged view of a designated portion of FIG. 5.

As shown in FIG. 1, a separate exhaust insert 106 can be inserted into each of the exhaust ports 108 while the exhaust manifold 104 is removed from the cylinder head 102. FIG. 5 shows an example of one of the exhaust inserts 106 disposed within one of the exhaust ports 108 of the cylinder head 102. The view shown in FIG. 5 can apply equally to all of the exhaust inserts 106.

As shown in FIG. 5, the exhaust insert 106 extends into both the cylinder head 102 and the exhaust manifold 104. The exhaust insert 106 is installed into one of the exhaust ports 108 of the cylinder head 102 such that the input end 114 of the exhaust insert 106 extends into the exhaust port 108. The exhaust insert 106 extends out of the exhaust port 108 and into a manifold port 128 of the exhaust manifold 104. The outside diameter of the flared region 122 increases towards the input end 114 of the exhaust insert 106 so as to allow for exhaust gases to smoothly enter the exhaust insert 106.

When the exhaust insert 106 is installed, the exhaust insert 106 preferably makes contact with some portion of the exhaust manifold 104 so as to allow for heat transfer from the exhaust insert 106 to the exhaust manifold 104. Thus, at least a portion of the outer surface of the exhaust insert 106 can be in contact with a surface of the exhaust manifold 104. Also, at least a portion of the outer surface of the exhaust insert 106 can be in contact with a surface of the cylinder head 102. For example, in the embodiment shown in FIG. 5, an outer surface of the beaded region 124 can be in contact with a surface of the exhaust manifold 104 and can also be in contact with a surface of the cylinder head 102. Also, an outer surface of the flared region 122 can be in contact with a surface of the cylinder head 102. However, the cylindrical region 120 between the flared region and the beaded region can be spaced from surfaces of the exhaust port 108 so as to reduce heat transfer from the exhaust insert 106 to the cylinder head 102. In some embodiments, a heat-insulating material can be located between the cylindrical region 120 and the exhaust port 108.

In some embodiments, the exhaust insert 106 can be a retrofit component that is designed to fit into, and be removed from, the cylinder head 102 somewhat easily so that no evasive modifications to the exhaust manifold 104 or the cylinder head 102 are necessary in order to utilize the exhaust insert 106. In some embodiments, the exhaust insert 106 can be frictionally held in place. Alternatively, the exhaust insert 106 can be held in place using fasteners, adhesives, and/or welds. In alternative embodiments, the exhaust insert 106 can be an integral component of the cylinder head 102 or the exhaust manifold 104 rather than a separate component.

The exhaust insert 106 provides for the transfer of a majority of exhaust heat from the cylinder head 102 into a surrounding water jacket 130 in the liquid-cooled exhaust manifold 104. The exhaust insert 106 is configured such that there is some clearance between the inner wall of the exhaust port 108 and the outer surface of the cylindrical region 120. In some embodiments, a layer of heat insulating material can be provided between the exhaust liner 106 and the inner wall of the exhaust port 108. Exhaust gases passing through the cylinder head 102 are in contact with the exhaust insert 106 rather than being in direct contact with the cylinder head 102. The exhaust insert 106 is preferrably formed of a metal having a relatively low thermal conductivity, for example stainless steel, so that the heat from exhaust gases will be wicked to a cooler place. Thus, heat from exhaust gases will be wicked to where the exhaust insert 106 makes contact with the exhaust manifold. The heat then migrates into the exhaust manifold, where the water jacket 130 can pull the heat into exhaust coolant and then transfer the into the atmosphere through a cooling system 132, which can include, for example, a radiator.

It will thus be appreciated that variations to the shape of the exhaust insert 106 are possible without deviating from the scope of the present disclosure. For example, alternative embodiments of the exhaust insert 106 are shown in FIGS. 7 and 8.

Figure 7:
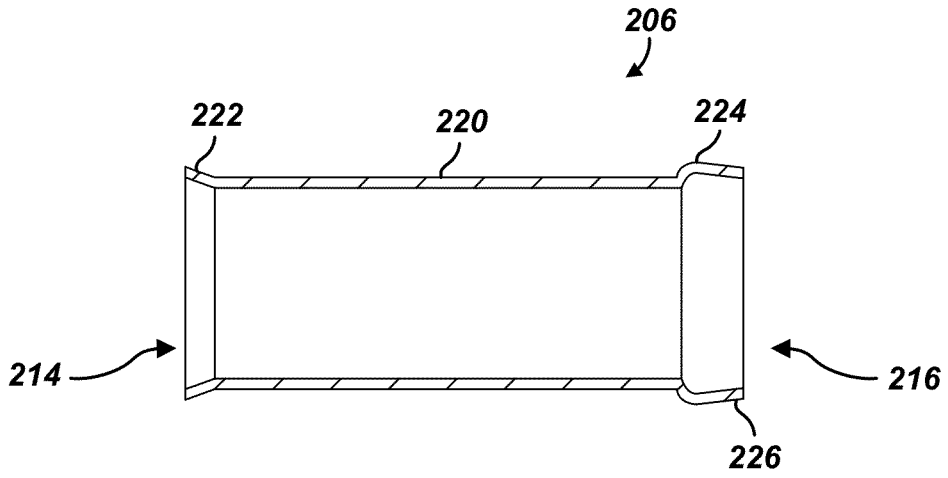
FIG. 7 shows a cross-sectional view of an alternative embodiment of the exhaust insert.
Figure 8:
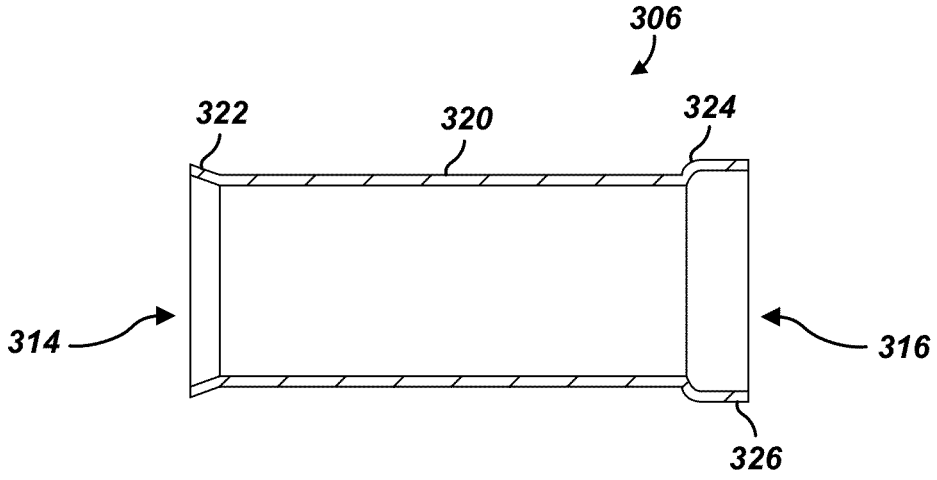
FIG. 8 shows a cross-sectional view of another alternative embodiment of the exhaust insert.

FIG. 7 shows a cross-sectional view of an exhaust insert 206, which serves as an alternative embodiment of the exhaust insert 106. In the illustrated embodiment, the exhaust insert 206 is generally cylindrical so as to conform at least somewhat to the interior shape of an exhaust port 108. It will thus be appreciated that alternative shapes are possible in order to conform to other exhaust ports. For example, while the exhaust insert 206 is generally linearly cylindrical, alternative embodiments can be generally curvilinearly cylindrical. Also, while the exhaust insert 206 has a somewhat circular cross-section (taken perpendicular to the section shown in FIG. 7), alternative embodiments can have alternative cross-sectional shapes.

The exhaust insert 206 includes an input end 214 and an output end 216. When the exhaust insert 206 is installed in the cylinder head 102, exhaust gases from a combustion chamber are received by the input end 214 and exit through the output end 216. A cylindrical region 220 extends between the input end 214 and the output end 216. In this embodiment, the exhaust insert 206 includes a flared region 222 in the vicinity of the input end 214. The exhaust insert 206 also includes a beaded region 224 in the vicinity of the output end 216 that transitions into a frustoconical region 226. The exhaust insert 206 is configured such that the outside diameter of the cylindrical region 220 is less than an outside diameter of the flared region 222, and the outside diameter of the cylindrical region 220 is also less than an outside diameter of the beaded region 224. In the illustrated embodiment, the outside diameter of the cylindrical region 220 is at least somewhat constant along the longitudinal axis of the exhaust insert 206. However, in alternative embodiments, the outside diameter of the cylindrical region 220 can vary. Also, while one flared region 222 and one beaded region 224 are shown, alternative embodiments can include additional regions of increased diameter, such as additional beaded regions 224.

The output end 216 of the exhaust insert 206 includes a frustoconical region 226 in place of the cylindrical extension 126 of the exhaust insert 106. The frustoconical region 226 extends between the beaded region 224 and the output end 216 of the exhaust insert 206. The outside diameter of the frustoconical region 226 can progressively decrease from the beaded region 224 to the output end 216 as shown in FIG. 7. When the exhaust insert 206 is installed in the engine assembly 100, the frustoconical region 226 will extend into a manifold port of the exhaust manifold 104. Thus, the outside diameter of frustoconical region 226 can be configured to fit within a port of the exhaust manifold 104.

FIG. 8 shows a cross-sectional view of an exhaust insert 306, which serves as another alternative embodiment of the exhaust insert 106. In the illustrated embodiment, the exhaust insert 306 is generally cylindrical so as to conform at least somewhat to the interior shape of an exhaust port 108. It will thus be appreciated that alternative shapes are possible in order to conform to other exhaust ports. For example, while the exhaust insert 306 is generally linearly cylindrical, alternative embodiments can be generally curvilinearly cylindrical. Also, while the exhaust insert 306 has a somewhat circular cross-section (taken perpendicular to the section shown in FIG. 8), alternative embodiments can have alternative cross-sectional shapes.

The exhaust insert 306 includes an input end 314 and an output end 316. When the exhaust insert 306 is installed in the cylinder head 102, exhaust gases from a combustion chamber are received by the input end 314 and exit through the output end 316. A first cylindrical region 320 extends between the input end 314 and the output end 316. In this embodiment, the exhaust insert 306 includes a flared region 322 in the vicinity of the input end 314. The exhaust insert 306 also includes a beaded region 324 in the vicinity of the output end 316 that transitions into a cylindrical extension 326. The exhaust insert 306 is configured such that the outside diameter of the first cylindrical region 320 is less than an outside diameter of the flared region 322, and the outside diameter of the first cylindrical region 320 is also less than an outside diameter of the beaded region 324. In the illustrated embodiment, the outside diameter of the first cylindrical region 320 is at least somewhat constant along the longitudinal axis of the exhaust insert 306. However, in alternative embodiments, the outside diameter of the cylindrical region 320 can vary. Also, while one flared region 322 and one beaded region 324 are shown, alternative embodiments can include additional regions of increased diameter, such as additional beaded regions 324.

The output end 316 of the exhaust insert 306 includes a cylindrical extension 326. The cylindrical extension 326 extends between the beaded region 324 and the output end 316 of the exhaust insert 306. The outside diameter of the cylindrical extension 326 can be at least somewhat constant and can be larger than the outside diameter of the first cylindrical region 320. When the exhaust insert 306 is installed in the engine assembly 100, the cylindrical extension 326 will extend into a manifold port of the exhaust manifold 104. Thus, the outside diameter of the cylindrical extension 326 can be configured to fit within a port of the exhaust manifold 104.

Still further alternative embodiments of the exhaust insert 106 can include alternatives to the flared region 122. For example, some alternative embodiments of the exhaust insert 106 can include a beaded region similar to beaded region 124 in place of the flared region 122. Also, some alternative embodiments of the exhaust insert 106 can include a beaded region similar to beaded region 124 in cooperation with the flared region 122, for example such that the beaded region transitions into a flared region. Still further embodiments of the exhaust insert 106 can include one or more bends, notches, or other shape features so as to accommodate an exhaust port and/or a manifold port into which the exhaust insert will be installed.

While certain embodiments of the inventions have been described above, it will be understood that the embodiments described are by way of example only. Accordingly, the inventions should not be limited based on the described embodiments. Rather, the scope of the inventions described herein should only be limited in light of the claims that follow when taken in conjunction with the above description and accompanying drawings.

What is claimed is:

1. An internal combustion engine comprising:

a cylinder head having an exhaust port; an exhaust manifold for receiving exhaust gas from the exhaust port; and an exhaust insert extending into the exhaust port and extending into the exhaust manifold, at least a portion of the exhaust insert being in contact with a exhaust-port surface and at least a portion of the exhaust insert being in contact with an exhaust-manifold surface.

2. The internal combustion engine of claim 1, wherein the exhaust insert comprises stainless steel.

3. The internal combustion engine of claim 1, wherein the exhaust insert includes a cylindrical extension disposed within the exhaust manifold.

4. The internal combustion engine of claim 1, wherein the exhaust insert includes a frustoconical region disposed within the exhaust manifold.

5. The internal combustion engine of claim 1, wherein the exhaust insert includes a beaded region.

6. The internal combustion engine of claim 5, wherein at least a portion of the beaded region is in contact with the exhaust-manifold surface.

7. The internal combustion engine of claim 6, wherein at least a portion of the beaded region is in contact with the exhaust-port surface.

8. The internal combustion engine of claim 1, wherein the exhaust insert includes a cylindrical region.

9. The internal combustion engine of claim 8, wherein at least a portion of an outer surface of the cylindrical region is spaced from the exhaust-port surface.

10. The internal combustion engine of claim 1, wherein the exhaust insert includes a flared region.

11. The internal combustion engine of claim 10, wherein at least a portion of the flared region is in contact with the exhaust-port surface.

12. A method of assembling an internal combustion engine, the method comprising:

inserting a first portion of an exhaust insert into an exhaust port of a cylinder head such that the first portion of the exhaust insert extends into the exhaust port, and such that at least some of the first portion of the exhaust insert is in contact with an exhaust-port surface; and inserting a second portion of the exhaust insert into an exhaust manifold such that the second portion of the exhaust insert extends into the exhaust manifold, and such that at least some of the second portion of the exhaust insert is in contact with an exhaust-manifold surface, wherein one of the inserting of the first portion and inserting of the second portion includes attaching the exhaust manifold to the cylinder head such that the exhaust manifold is suitable for receiving exhaust gas from the exhaust port through the exhaust insert.

13. The method of claim 12, wherein the exhaust insert comprises stainless steel.

14. The method of claim 12, wherein the exhaust insert includes a cylindrical extension, and wherein the inserting of the second portion of the exhaust insert into the exhaust manifold includes disposing the cylindrical extension within the exhaust manifold.

15. The method of claim 12, wherein the exhaust insert includes a frustoconical region, and wherein the inserting of the second portion of the exhaust insert into the exhaust manifold includes disposing the frustoconical region within the exhaust manifold.

16. The method of claim 12, wherein the exhaust insert includes a beaded region.

17. The method of claim 16, wherein the inserting of the second portion of the exhaust insert into the exhaust manifold includes making contact between at least a portion of the beaded region and the exhaust-manifold surface.

18. The method of claim 17, wherein the inserting of the first portion of the exhaust insert into the exhaust port of the cylinder head includes making contact between at least a portion of the beaded region and the exhaust-port surface.

19. The method of claim 12, wherein the exhaust insert includes a cylindrical region.

20. The method of claim 19, wherein the inserting of the first portion of the exhaust insert into the exhaust port of the cylinder head includes providing a gap between at least a portion of an outer surface of the cylindrical region and the exhaust-port surface.

21. The method of claim 12, wherein the exhaust insert includes a flared region.

22. The method of claim 21, wherein the inserting of the first portion of the exhaust insert into the exhaust port of the cylinder head includes making contact between at least a portion of the flared region and the exhaust-port surface.

23. An exhaust insert for extending into an exhaust port of an engine cylinder head and extending into an exhaust manifold, comprising:

an insert body having a first end and a second end;

a flared region disposed proximate the first end and configured to contact the exhaust port of the cylinder head;

a beaded region disposed proximate the second end and configured to contact the exhaust manifold;

a cylindrical region disposed between the flared region and the beaded region, wherein at least a portion of an outer surface of the cylindrical region is configured to be spaced from the exhaust port of the cylinder head.

24. The exhaust insert of claim 23, wherein the insert body is configured to transfer heat by conduction from the cylinder head to the exhaust manifold via a contact connection between the flared region and the exhaust port and the beaded region and the exhaust manifold.

25. The exhaust insert of claim 23, wherein the second end of the insert body further comprises a cylindrical extension configured to extend into the exhaust manifold.

26. The exhaust insert of claim 23, wherein the second end of the insert body further comprises a frustoconical extension configured to extend into the exhaust manifold.

* * * * *